US008116936B2

(12) United States Patent
Hershey et al.

(10) Patent No.: US 8,116,936 B2
(45) Date of Patent: Feb. 14, 2012

(54) METHOD AND SYSTEM FOR EFFICIENT DATA COLLECTION AND STORAGE

(75) Inventors: John Erik Hershey, Ballston Lake, NY (US); Jeanette Marie Bruno, Saratoga Springs, NY (US); Brock Estel Osborn, Niskayuna, NY (US); Naresh Sundaram Iyer, Clifton Park, NY (US); Charles Larry Abernathy, West Chester, OH (US); Michael Dean Fullington, West Chester, OH (US)

(73) Assignee: General Electric Company, Niskayuna, NY (US)

( * ) Notice: Subject to any disclaimer, the term of this patent is extended or adjusted under 35 U.S.C. 154(b) by 1159 days.

(21) Appl. No.: 11/860,626

(22) Filed: Sep. 25, 2007

(65) Prior Publication Data

US 2009/0082919 A1 Mar. 26, 2009

(51) Int. Cl.
*F02D 45/00* (2006.01)

(52) U.S. Cl. ..... 701/35; 701/14; 341/155; 704/203; 704/500

(58) Field of Classification Search ..... 701/35, 701/14; 341/155; 704/203, 500
See application file for complete search history.

(56) References Cited

U.S. PATENT DOCUMENTS 4,409,670 A 10/1983 Herndon et al.
4,470,116 A * 9/1984 Ratchford ..... 701/35
4,660,145 A * 4/1987 Hansen ..... 701/14
5,302,950 A 4/1994 Johnson et al.
5,497,435 A * 3/1996 Berger ..... 382/249
5,543,792 A * 8/1996 Johnson et al. ..... 341/123
6,009,356 A 12/1999 Monroe
6,092,008 A * 7/2000 Bateman ..... 701/14
6,215,821 B1 4/2001 Chen
6,278,913 B1 * 8/2001 Jiang ..... 701/3
6,392,705 B1 * 5/2002 Chaddha ..... 348/388.1
6,396,422 B1 * 5/2002 Barkan ..... 341/76
6,608,589 B1 * 8/2003 Devereux et al. ..... 342/357.29
6,628,995 B1 * 9/2003 Korson et al. ..... 700/74
6,735,505 B2 5/2004 Levine
6,859,170 B2 * 2/2005 Devereux et al. ..... 342/357.29
6,934,677 B2 * 8/2005 Chen et al. ..... 704/200.1

(Continued)

OTHER PUBLICATIONS

Slepian and Wolff; Noiseless Coding of Correlated Information Sources; vol. IT-19, No. 4, Jul. 1973, pp. 471-480.

(Continued)

*Primary Examiner* — Thomas Black
*Assistant Examiner* — Wae Louie
(74) *Attorney, Agent, or Firm* — Penny A. Clarke

(57) ABSTRACT

A system for collecting and storing performance data for an engine is provided. The system includes one or more sensors configured to generate sensor data signals representative of one or more engine data performance parameters. The system further includes a data sampling component, a data quantizing component, a data storage sampling rate component, a data encoding component and a data storage component. The data sampling component is configured to sample the sensor data signals at a data sampling rate. The data quantizing component is configured to generate quantized data samples corresponding to the sampled sensor data signals. The data storage sampling rate component is configured to determine a data storage sampling rate for the quantized data samples, based on an analysis of at least a subset of the quantized data samples. The data encoding component is configured to encode the quantized data samples according to the data storage sampling rate, and the data storage component is configured to store the encoded data samples from the encoding component.

16 Claims, 7 Drawing Sheets

U.S. PATENT DOCUMENTS

| | | | | |
|---|---|---|---|---|
| 7,064,677 | B2 * | 6/2006 | Newman | 340/854.6 |
| 7,082,164 | B2 * | 7/2006 | Chaddha | 375/240.12 |
| 7,260,501 | B2 * | 8/2007 | Pattipatti et al. | 702/183 |
| 7,388,908 | B2 * | 6/2008 | Dowling | 375/229 |
| 7,460,990 | B2 * | 12/2008 | Mehrotra et al. | 704/206 |
| 7,596,242 | B2 * | 9/2009 | Breed et al. | 382/103 |
| 2003/0152145 | A1 * | 8/2003 | Kawakita | 375/240.12 |
| 2003/0225492 | A1 | 12/2003 | Cope et al. | |
| 2004/0027255 | A1 * | 2/2004 | Greenbaum | 340/945 |
| 2005/0231396 | A1 * | 10/2005 | Dunn | 341/50 |
| 2007/0028220 | A1 * | 2/2007 | Miller et al. | 717/124 |
| 2008/0310742 | A1 * | 12/2008 | Kostrzewski et al. | 382/236 |
| 2009/0041021 | A1 * | 2/2009 | Meany et al. | 370/394 |
| 2009/0082919 | A1 * | 3/2009 | Hershey et al. | 701/35 |

OTHER PUBLICATIONS

Wyner and Ziv; The Rate-Distortion Function for Source Coding with Side Information at the Decoder; vol. IT-22, No. 1, Jan. 1976, pp. 1-10.

* cited by examiner

METHOD AND SYSTEM FOR EFFICIENT DATA COLLECTION AND STORAGE

BACKGROUND

The invention relates generally to monitoring the health of an engine and more particularly to a system and method for collecting and storing monitored engine data indicative of the health of an engine.

An engine is typically monitored to assess the performance of the engine in its healthy operative state so that the engine may be controlled in a near optimal manner. An engine is also monitored to detect anomalous conditions indicative of degrading engine health so that malfunctions or faults in the engine may be diagnosed in a timely manner. In general, it is desirable that sufficient data from a monitoring suite of sensors is collected and stored, so that technical personnel can be provided with an insight into the fault or failure and be able to diagnose, post incident, the conditions leading to the particular fault or failure. Beyond the need to have a suite of sensors to monitor the requisite engine parameters at an appropriate rate and be able to adequately reproduce a time series of sensor data measurements for future analysis, it is also necessary to ensure that requisite storage space is available to store the monitored data from the sensors.

Complex mechanical systems such as an aircraft typically employ an onboard data acquisition system for collecting digital flight data. In such systems, a number of sensors distributed throughout the aircraft provide data signals representative of the performance of the aircraft and its engines. This flight data is stored in an attendant, physically robust flight data recorder (commonly referred to as the "black box"), so that in the unlikely event of an in-flight mishap, the flight data recorder can be removed and the stored flight performance data and can be analyzed to determine the cause of the mishap. The stored flight data can also be used proactively in diagnostic maintenance of in-flight anomalies.

Flight data recorders collect a predefined set of data parameters at a fixed sampling rate throughout the entire flight. However, and as will be appreciated by those skilled in the art, many aircraft or engine anomalies require data to be collected at higher sampling rates to understand and diagnose faults. For example, in the case of a new aircraft, it is especially important to ensure that anomalous conditions are noted, monitored, and the monitored data preserved for future analysis. Furthermore, some new aircraft will simply not have enough on-board storage to retain the vast amount of data that is produced at a high rate of sampling. This may be a concern especially for new military high performance aircraft that must economize on weight and space. To add to this, the sampling rate of the data that can be collected is typically limited by the capacity of the recorder's storage medium, the physical constraints of the recorder's storage capacity and the expected duration of the flight.

It would be desirable to develop a method and system for collecting flight data at appropriate sampling rates, while efficiently consuming the available storage capacity before the flight ends. In addition, it would be desirable to develop a technique that preserves data preceding the onset of a fault so that anomalous conditions may be captured and detected from the sampled data.

BRIEF DESCRIPTION

Embodiments of the present invention address this and other needs. In one embodiment, a system for collecting and storing performance data for an engine is provided. The system includes one or more sensors configured to generate a plurality of sensor data signals representative of one or more engine data performance parameters. The system further includes a data sampling component, a data quantizing component, a data storage sampling rate component, a data encoding component and a data storage component. The data sampling component is configured to sample the sensor data signals at a data sampling rate. The data quantizing component is configured to generate a plurality of quantized data samples corresponding to the sampled sensor data signals. The data storage sampling rate component is configured to determine a data storage sampling rate for the quantized data samples, based on an analysis of at least a subset of the quantized data samples. The data encoding component is configured to encode the quantized data samples according to the data storage sampling rate and the data storage component is configured to store the encoded data samples from the encoding component.

In another embodiment, a method for collecting and storing performance data for an engine is provided. The method includes receiving a plurality of sensor data signals, representative of one or more engine data performance parameters. The method further includes the steps of sampling the sensor data signals at a data sampling rate, generating a plurality of quantized data samples corresponding to the sampled sensor data signals, analyzing at least a subset of the quantized data samples to determine a data storage rate for the quantized data samples and encoding and storing the quantized data samples according to the data storage sampling rate.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
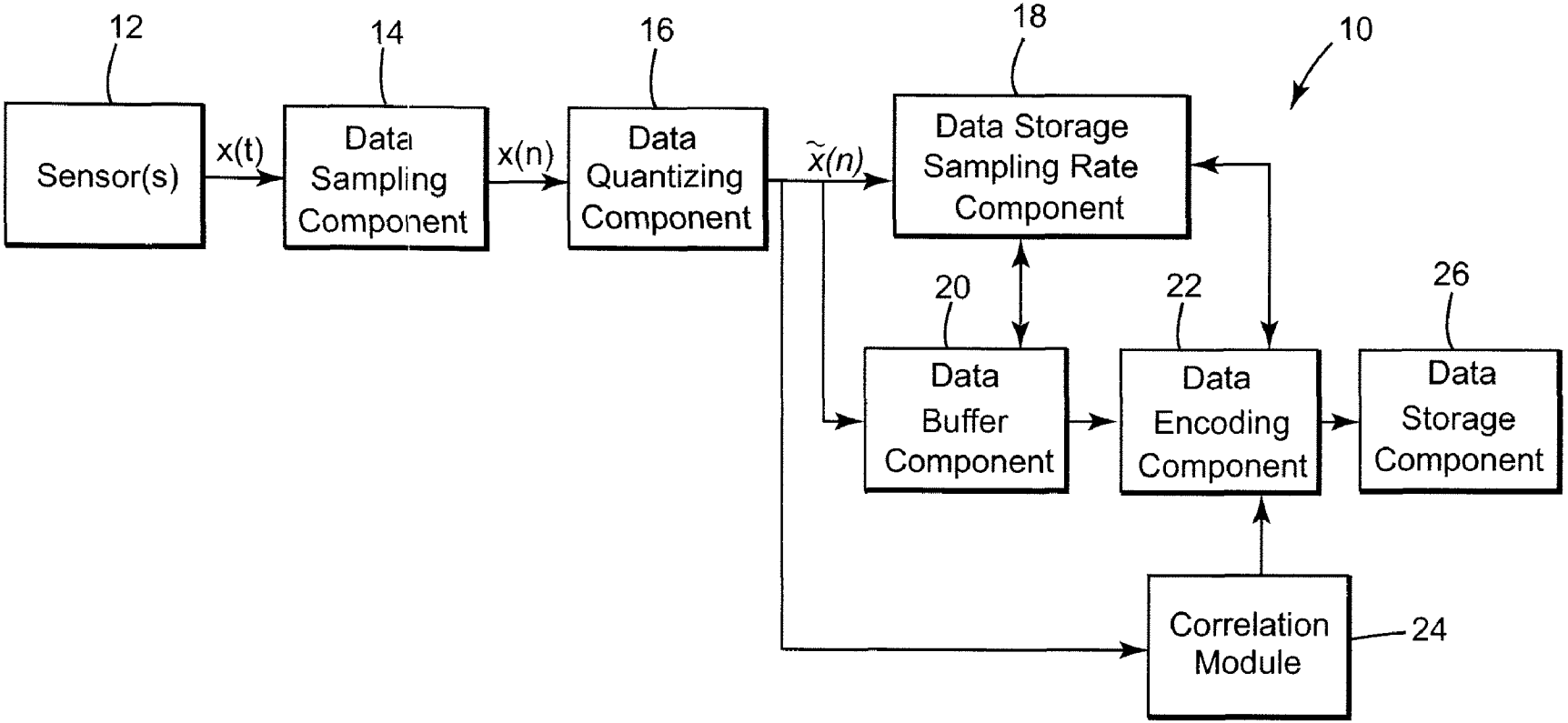
FIG. 1 is an exemplary illustration of a system for collecting and storing performance data for an engine, in accordance with one embodiment of the present invention.

FIG. 1 is an exemplary illustration of a system for collecting and storing performance data for an engine, in accordance with one embodiment of the present invention. In one embodiment, the system 10 is configured to collect and store data from an aircraft having at least one engine. It may be noted, however, that the data collection and storage for additional engines may be accomplished by the system 10 in a manner identical to that for a single engine. Further, the disclosed system may also be configured to collect and store data for other types of engines, such as, for example, land based power generation engines, marine transportation engines and machine tools, as well as other types of mechanical systems.

Referring to FIG. 1, the system 10 generally includes one or more sensors 12, a data sampling component 14, a data quantizing component 16, a data storage sampling rate component 18 and a data encoding component 22. In one embodiment, the sensors 12 are configured to monitor one or more parameters related to one or more phases of aircraft engine operation and extract specific data during flight phases of interest, such as, for example, take off, climb and steady cruise. The sensors 12 may include one or more conventional aircraft sensors, to sense and monitor the aircraft's air speed and altitude, among other parameters and/or one or more engine sensors to sense and monitor one or more engine parameters of interest. Example engine parameters include, but are not limited to, exhaust gas temperature, engine fuel flow, core speed, compressor discharge pressure, turbine exhaust pressure and fan speed. The engine parameters may further be recorded onboard by the sensors 12, and accessed later by ground maintenance personnel for processing or remotely transmitted to ground locations during flight operations, for real-time processing, in a manner as will be described in greater detail below.

In a particular embodiment, and as shown in FIG. 1, the sensors 12 are configured to generate a plurality of sensor data signals $x(t)$ representative of one or more engine parameters of interest. The data sampling component 14 is configured to sample the sensor data signals $x(t)$ at a pre-defined data sampling rate. In one embodiment, and as will be described in greater detail below, the data sampling component 14 is configured to sample the sensor data signals $x(t)$ at a rate sufficient to always sample $x(t)$ for accurate reconstruction, for example, at the Nyquist rate for those periods of time when $x(t)$ exhibits its highest significant frequencies. The data sampling component is further configured to produce a plurality of discrete sequential samples $\{x(n)\}$. The data quantizing component 16 is configured to generate a plurality of quantized data samples corresponding to the sampled sensor data signals. In one embodiment, the data quantizing component 16 is configured to convert the discrete sequential sample, $x(n)$, into its closest numerical value, $\hat{x}(n)$, of a given finite alphabet of values, $\{\hat{x}(n)\}$. As is known to those skilled in the art of signal sampling theory, the samples $\{x(n)\}$ approximate $\{x(n)\}$ as $\hat{x}(n)=x(n)+e(n)$, where $\{e(n)\}$ are errors that may be made arbitrarily small by increasing the cardinality of the alphabet of values.

A data buffer component 20 is configured to store the quantized data samples $\{\hat{x}(n)\}$ at the data sampling rate determined by the data sampling component 14. In one embodiment, the data buffer component 20 may include a delay or storage capacity of a pre-defined number of time units to capture and store the quantized data samples. In one embodiment, the data buffer component 20 is also configured to capture and store one or more transient data segments comprising the quantized data samples. The transient data segments may be indicative of one or more engine operational conditions that typically precede the onset of a fault. For example, a transient data segment may be a segment of the sensor time series data in which the readings of one or more of the sensors change values in such a way that they no longer follow the statistical distribution or range of their previous data values. In one embodiment, the transient data segments may include one or more data segments related to transitions between engine flight phases, such as a take off or a climb.

Referring to FIG. 1 again, the data storage sampling rate component 18 is configured to determine a data storage sampling rate for the quantized data samples $\hat{x}(n)$, based on an analysis of at least a subset of the quantized data samples stored in the data buffer component 20. In one embodiment, the analysis comprises determining the down select rate at which the sampled sensor data signals need to be stored, in order to be able to reproduce the quantized data samples with sufficient accuracy, within a pre-defined number of time units. For example, if the quantized data samples $\hat{x}(n)$ are produced by the data sampling component 12, sampling at twice the necessary sampling rate, then the data storage sampling rate component 16 may determine that only every other quantized data sample needs be stored in order to faithfully reproduce the data from the sensors 12. In one embodiment, the data storage sampling rate is determined based upon identifying at least one frequency component from the sensor data signals. In a particular embodiment, the data storage sampling rate component 18 is configured to determine the frequency of the highest frequency significant component from the sensor data signals. This frequency determines the minimum data storage sampling rate for accurate representation of the sampled and quantized sensor signals. The minimum data storage sampling rate may be determined using various techniques known in the art, such as, for example, the Nyquist condition that specifies a minimum storage sampling rate of twice the frequency of the highest frequency significant component. In one embodiment, this frequency may also be used to set the upper limit of a low pass filter, (not shown in FIG. 1), in order to prevent a deleterious condition known in the art of signal processing, as aliasing.

In one embodiment, the data storage sampling rate component 16 is further configured to detect an anomalous event based on the transient data segments preserved by the data buffer component 20. In a particular embodiment, the data storage sampling rate component 16 is configured to identify the data preceding the onset of a fault to detect an anomalous event, by analyzing a subset of the quantized data samples stored in the data buffer component 20. The data storage sampling rate component 18 may further be configured to modify the data storage sampling rate in response to the detection of the anomalous event. For example, during periods of aircraft turbulence, vibration sensors are used to measure the vibration of the aircraft. Under steady flight, with no air turbulence, the measurement values from these sensors remain within a certain range, such as, for example, between, 14.5 and 20.3. However, when the aircraft experiences clear air turbulence, the data measurements from the vibration sensors may be in a much higher range, such as, for example, between 30.2 and 35.8 for approximately five minutes until the aircraft passes through the clear air turbulence. This period of a higher range of readings is an example of a transient data segment, and once detected, may trigger the data storage sampling rate component 16 to record data from all the sensors at a more frequent rate in order to collect detailed data on how the aircraft performs in turbulent conditions.

In one embodiment, the data storage sampling rate component may be configured to increase the data storage sampling rate to its highest sampling frequency for all of the sensors, if the reading from the vibration sensors exceeds 25.0. In addition, the data quantizing element may change the alphabet of values recorded for the various sensors. Once the vibration sensor reading drops below 21.0, the lower or base level data storage sampling rate and base level alphabet of values may be used.

In another embodiment, a moving average (i.e., the sample average based on the last N values, where N is an integer, for example, N may be equal to 20) may be calculated. If this moving average value exceeds a predefined value, then a higher storage sampling rate and a different alphabet of values may be used for all the sensors. If it drops to a predefined value, the base level data sampling rate and alphabet of values may be used.

In yet another embodiment, standard statistical process control methodologies may be used to determine when a transient data segment occurs. In this case, the sample average and sample standard deviation for normal conditions may be calculated (e.g., during a time in which the aircraft is operating in steady cruise conditions in the absence of turbulence). Then during on-going data collection, the last N readings (where N is an integer and may be, for example, 20) may be averaged together and subtracted from this normal operating condition sample average. If the absolute value of this difference is greater than two of the normal operating condition standard deviations, for example, a conclusion may be reached that the sensor value has changed and higher sampling frequency and different alphabet of values is required for all of the sensors.

Referring to FIG. 1, the data encoding component 22 is configured to encode the quantized data samples according to the data storage sampling rate determined by the data storage sampling rate component 18. In one embodiment, the data storage sampling rate component 18 is configured to instruct the data encoding component 22 as to the necessary minimum sampling or decimation rate of the quantized data samples proceeding through the data buffer component 20. As discussed below with reference to FIGS. 5 and 6, certain engine parameters may be highly correlated. Beneficially, such correlations can be leveraged to reduce the amount of data that must be stored. Accordingly, in a particular embodiment, the data encoding component 22 may also be configured to compress the quantized data samples corresponding to the sampled sensor data signals, based on one or more correlation measures identified by a correlation module 24. One non-limiting example of a correlation measure is a correlation coefficient, $\rho$, that measures the degree of correlation between respective engine parameters. The identified correlation measures may further be communicated to the data storage sampling rate component 18, by the data encoding component 22. An anomalous event, may affect the rate at which the data must be stored. Accordingly, the data storage sampling rate component 18 may further be configured to detect an anomalous event and modify the data storage sampling rate based on the identified correlation measures, in a manner as will be described in greater detail below. The compression of the correlated quantized data samples may be performed using one or more techniques known in the art, such as, for example, Hamming, Hankamer or LZW coding applied to blocks of the data or the successive differences of data samples or blocks of data samples.

The encoded quantized data samples are then output to a data storage component 26 that provides on-board storage for the encoded quantized data samples or transmits the encoded quantized data samples to a platform other than the host aircraft, such as another aircraft or a ground site.

Figure 2:
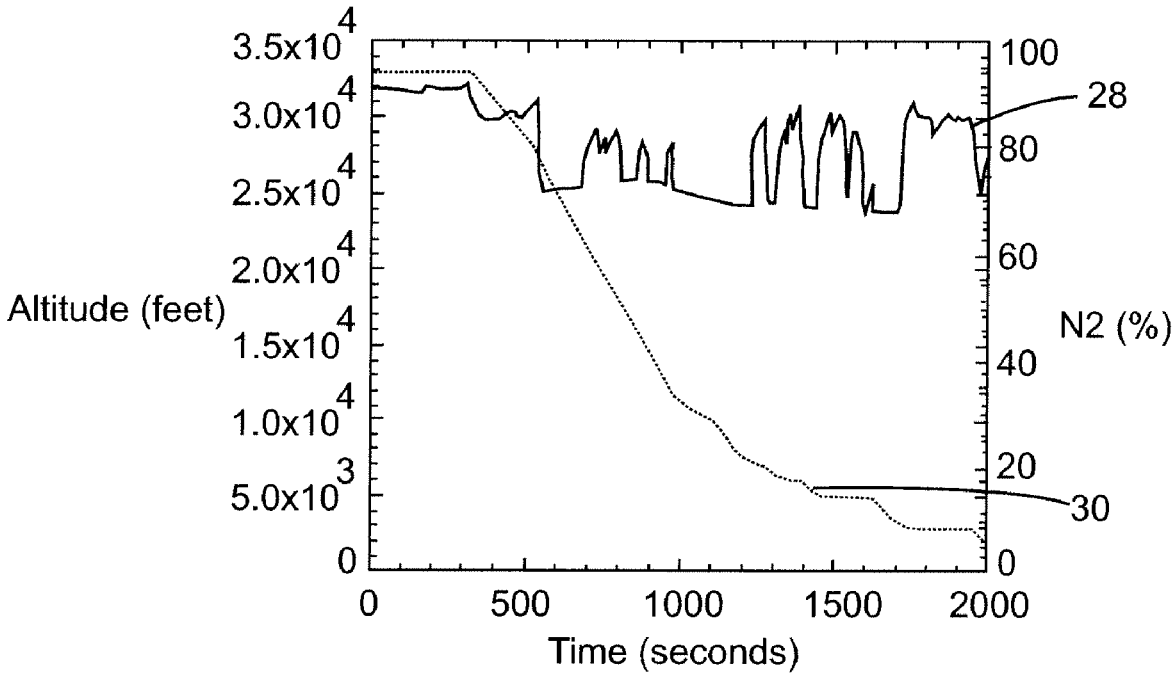
FIG. 2 is a graph illustrating an exemplary plot of the data between the engine core speed and the aircraft altitude for a typical aircraft engine, over a period of time.

Example applications of the present invention to engine core speed data are discussed below with reference to FIGS. 2-6. Although the illustrated examples are directed to engine core speed data, the invention is broadly applicable to performance data for aircraft parameters. FIG. 2 is a graph illustrating an exemplary plot of the data between the engine core speed and the aircraft altitude for a typical aircraft engine, over a period of time. In the example shown in FIG. 2, a data record of the engine core speed of the high-pressure compressor, indicated by the reference numeral 28, and the aircraft altitude, indicated by the reference numeral 30 is plotted over the duration of a typical flight. In the particular example shown in FIG. 2, the aircraft engine is in a "cruise flight" phase for the first 300 seconds of the data record and then transcends the cruise phase for descent, after 300 seconds. As indicated in FIG. 2, the engine core speed of the high speed compressor is relatively constant prior to descent, whereas the core speed data fluctuates considerably immediately prior to and during descent. Qualitatively, a lower data storage sampling rate can thus be used prior to the onset of the transient phase, which immediately precedes the descent, while a higher data storage rate would be necessary to adequately capture the data fluctuations present in the engine core speed data during the transient phase and descent. Specific examples of means for determining the data storage sampling rates prior to and during descent are discussed below with reference to FIGS. 3 and 4.

Figure 3:
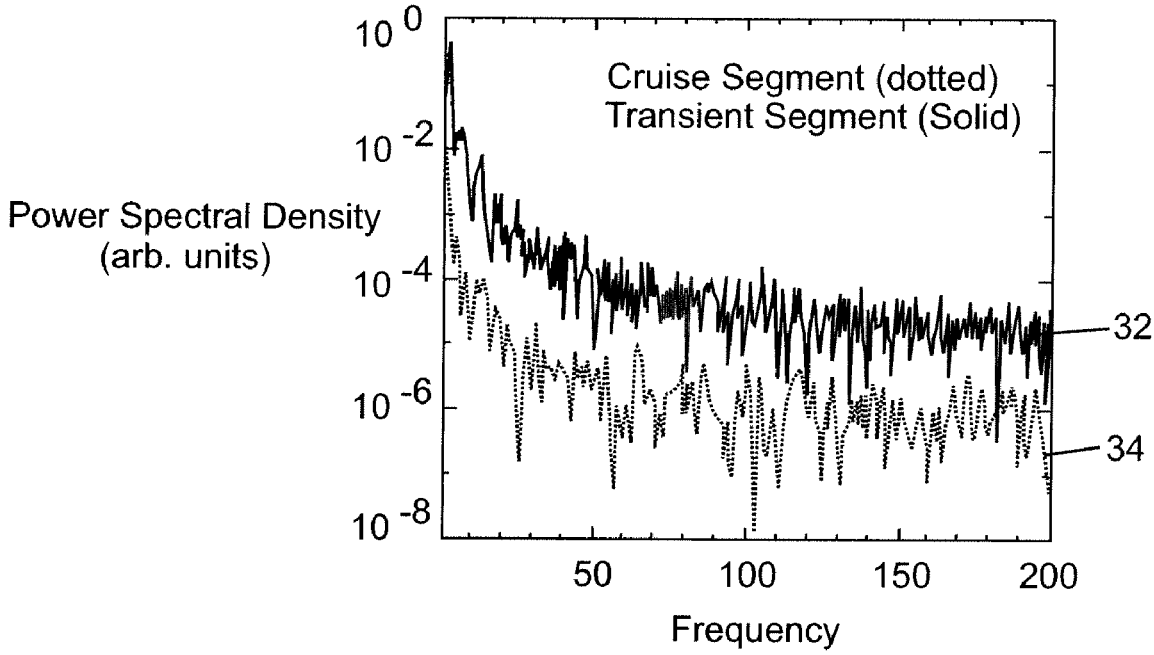
FIG. 3 is a graph displaying the power spectral density of the data values for the engine core speed over two time periods.

FIG. 3 is a graph displaying the power spectral density of the data values for the engine core speed over two time periods. In the example shown in FIG. 3, reference numeral 34 indicates the power spectral density of the sequence of values for the engine core speed of the high-pressure compressor in the cruise flight phase. The cruise flight phase corresponds to the time period from 50 to 250 seconds. Also, shown in FIG. 3, reference numeral 32 indicates the sequence of values for the power spectral density for the engine core speed of the high-pressure compressor, in the transient flight phase. The transient flight phase corresponds to the time period from 250 to 450 seconds. The transient flight phase sequence of values overlaps the end of the cruise flight phase and the beginning of the descent flight phase. A "transient flight phase" is generally understood to describe a flight phase that is not in a steady state. The power spectral densities may be computed by techniques well known to those skilled in the art, by first taking the Fourier transform of the zero-padded sequences and then multiplying them term-by-term against their conjugate values. In one embodiment, these calculations are performed within the data storage sampling rate component 18, described above.

Figure 4:
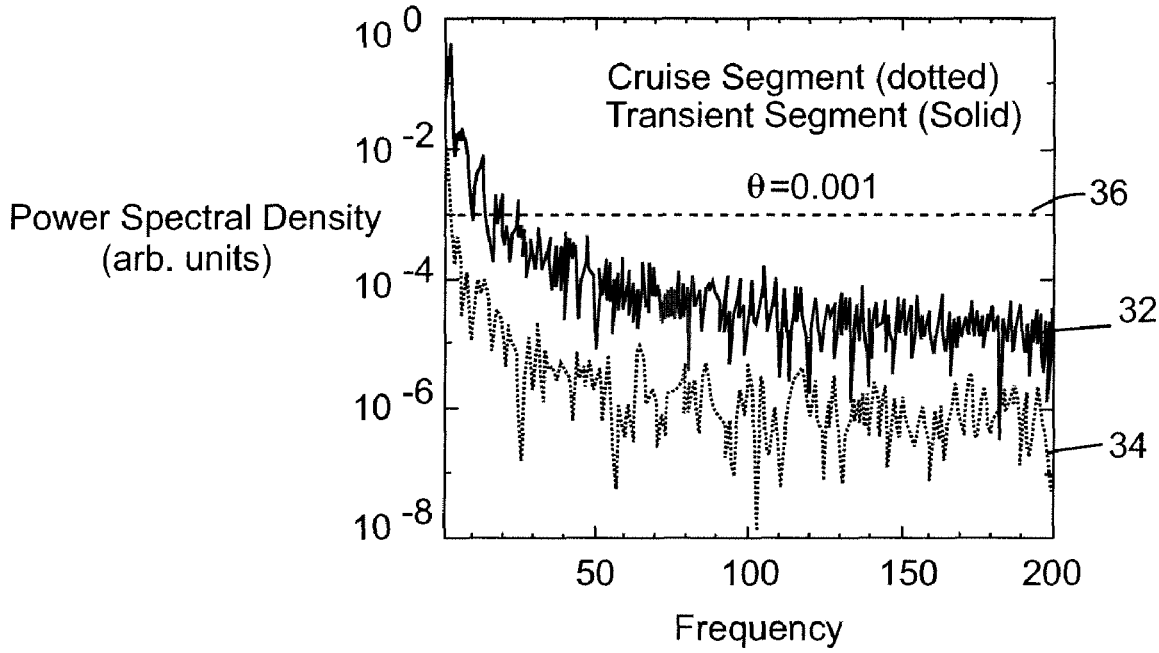
FIG. 4 is an illustration of the power spectral density displays shown in FIG. 3, overlaid with a threshold value.

FIG. 4 is an illustration of the power spectral density displays shown in FIG. 3, overlaid with a threshold value. In one embodiment, the threshold value $\theta$ is used to partition the components of the power spectral density frequencies shown in FIG. 3, into significant components, i.e., those components whose frequencies lie at or above the value of $\theta$, and insignificant components, i.e., those components whose frequencies lie below the value of $\theta$. In this manner, the data storage sampling rate component 18 may determine the frequency of the highest frequency significant component of a data segment. This frequency determines the minimum data storage sampling rate for accurate representation of the sampled and quantized sensor signal. This operation can be repeated for other data segments, to determine the minimum data storage sampling rates for each of the respective data segments. It should be noted that although only two data segments are shown in FIGS. 3 and 4, this analysis is applicable to any number of data segments for one or more quantized sensor signals. In the example shown in FIG. 4, the threshold value $\theta=0.001$. For the particular example shown in FIG. 4, the arbitrarily selected threshold value $\theta=0.001$ indicates that the highest significant component frequency of the transient segment 32 is about 22 and the highest significant component frequency of the cruise segment 36 is about 2. The value of $\theta$ may be input into the data storage sampling rate component 18. Further, and as described above, based on the Nyquist condition for determining the minimum sampling rate, the data storage sampling rate component 18 may determine that the transient data segment 32 must be sampled 11 times faster than the cruise data segment 36, thereby implying the existence of higher frequency values of significance in the transient data as compared to the cruise data, and indicating a departure from the steady state.

Figure 5:
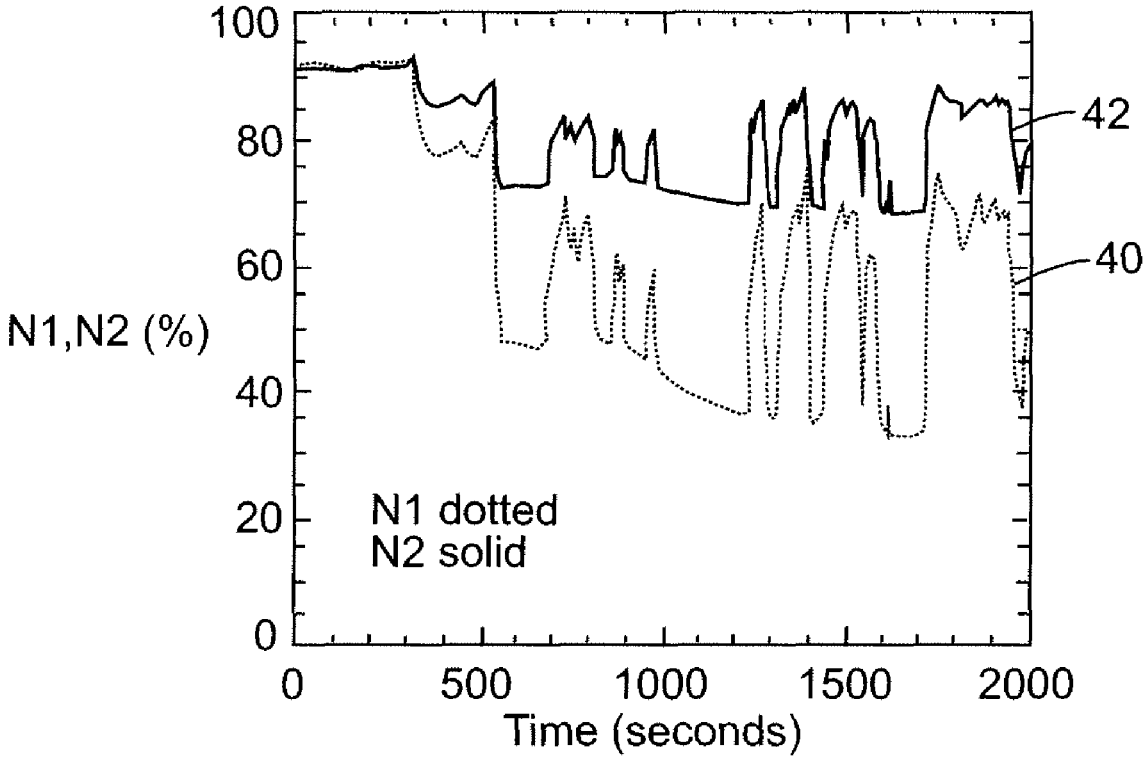
FIG. 5 is a graph illustrating exemplary data plots for two engine performance parameters over time.

As noted above, correlations between various engine parameters can be exploited to further reduce data storage requirements. FIG. 5 is a graph illustrating exemplary data plots for two engine performance parameters over time. In the example shown in FIG. 5, the two parameters recorded are the engine core speed 42 (N2) of the high-pressure compressor, and the low-pressure compressor or fan 40 (N1). It may be noted that the data values of the two parameters are very similar, and hence recording them separately would likely consume twice as much storage as would be consumed by recording either one of the parameters. In accordance with one embodiment of the present invention, and as described with respect to FIG. 6 below, the efficient storage and compression of the quantized data samples may be further enhanced, based upon identifying one or more correlation measures between the engine performance parameters.

Figure 6:
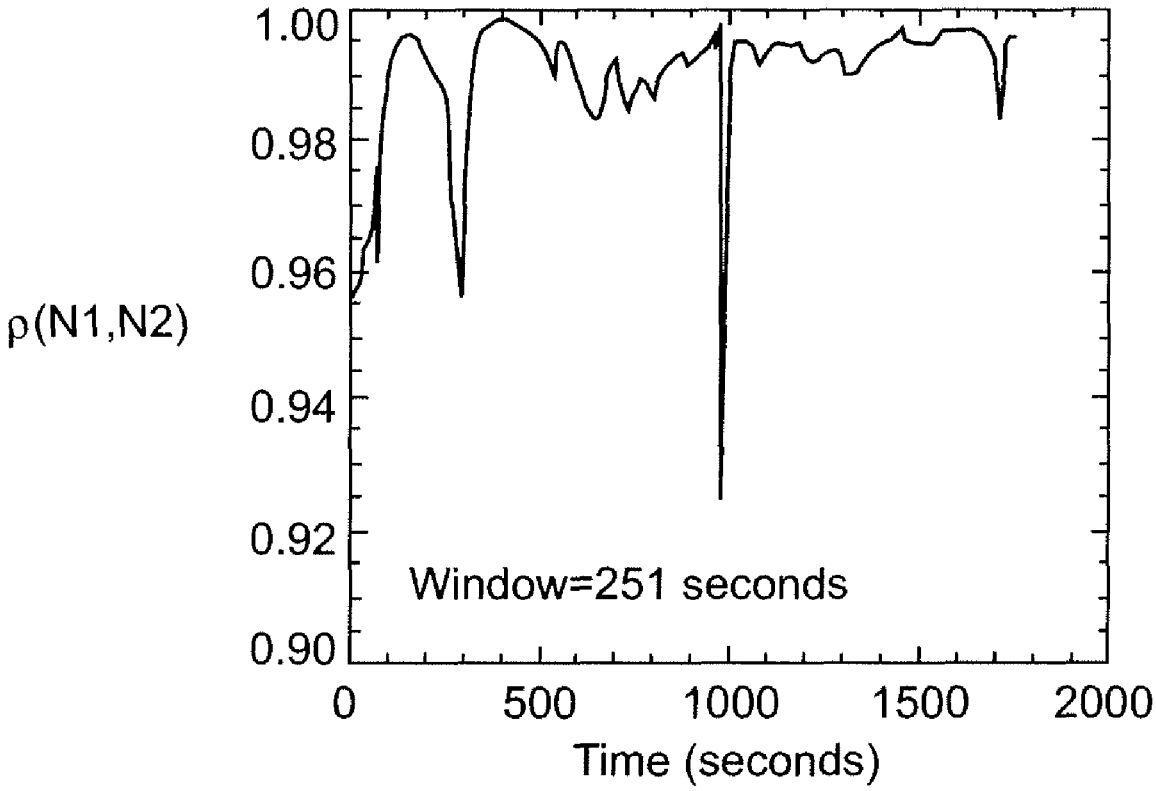
FIG. 6 is a graph displaying the correlation coefficient computed for two engine performance parameters, over a period of time.

FIG. 6 is a graph displaying the correlation coefficient computed for two engine performance parameters, over a period of time. In the example shown in FIG. 6, the correlation coefficient, ρ, computed over two engine performance parameters, the engine core speed N2 and the low-pressure compressor or fan N1, is displayed, using a sliding window of width 251 seconds. It may be noted in the example shown in FIG. 6 that the correlation between N1 and N2 exceeds 0.92 for the parameters of interest. This implies that a significant correlation exists between the two parameters, indicating that significant data compression may be achieved. A variety of techniques are known in the art and may be used to determine inter-sensor correlations ahead of time. Further, one or more data compression techniques known in the art may be tuned to these a-priori known correlations ahead of flight, or the existing redundancies could be estimated in-flight. A variety of techniques for compressing, storing and transmitting two or more records of data that exhibit significant cross-correlations are known in the art. See for example, "Noiseless Coding of Correlated Information Sources" by Slepian and Wolf, IEEE Transactions on Information Theory, Vol. IT-19, No. 4, July 1973, pp. 471-480 and "The Rate-Distortion Function for Source Coding with Side Information at the Decoder," by Wyner and Ziv, IEEE Transactions on Information Theory, Vol. IT-22, No. 1, January 1976, pp. 1-10.

In one example, the compression of two or more data records exhibiting significant cross-correlations is accomplished by performing a Gramm-Schmidt orthonormalization and subsequent coding of the residuals. Further, the two or more records of data exhibiting significant cross-correlations may be formed from different parameters for the same engine as N1 and N2, or it may be formed from appropriately time-registered parameters from different engines on the same multi-engine aircraft.

In one embodiment, the sensors 12 may further be monitored by the data encoding component, based on the identified correlations and the system 10 may function as a continuing check on the proper functioning of the sensors 12 whose outputs are normally correlated. For example, if the expected correlation drops below a particular value, then a state of possible sensor failure may be declared. In one embodiment, the system 10 may default to saving all independent sensor readings, as it may not be immediately clear to identify the particular failed sensor. In another embodiment, the correlations may be computed dynamically on-board, and the existing redundancies may be dynamically estimated and storage reduced by appropriate compression schemes.

In another embodiment, the sensors 12 may be monitored using a multi-variate statistical process control monitoring technique, so that data is only collected when deviations in the multivariate statistic, such as, for example, the Hotelling's T-Square (or T-2) or Chi-Square, occur. In this embodiment, the multi-variate distribution of the set of sensors, or sensor subsets, is characterized using a sufficient number of flight-regime points either from the current flight or historical flights. Sensor data is then recorded only when there are statistically significant deviations in the distribution statistic. In one example, if the T-2 statistic for the current set of readings is calculated and falls in the normal range, the readings may not be recorded, but if the statistic is out of control with a k % confidence value, then the readings may be recorded, where k is a selected confidence value.

Referring to FIG. 1 again, the data encoding component 22 may further be configured to compress the data from a single sensor if it determines that the data has exploitable and removable redundancies, using one or more techniques known in the art, for accomplishing single sensor data encoding and compression. The data proceeding from the data encoding component 22 may then be output to the data storage component 26.

Figure 7:
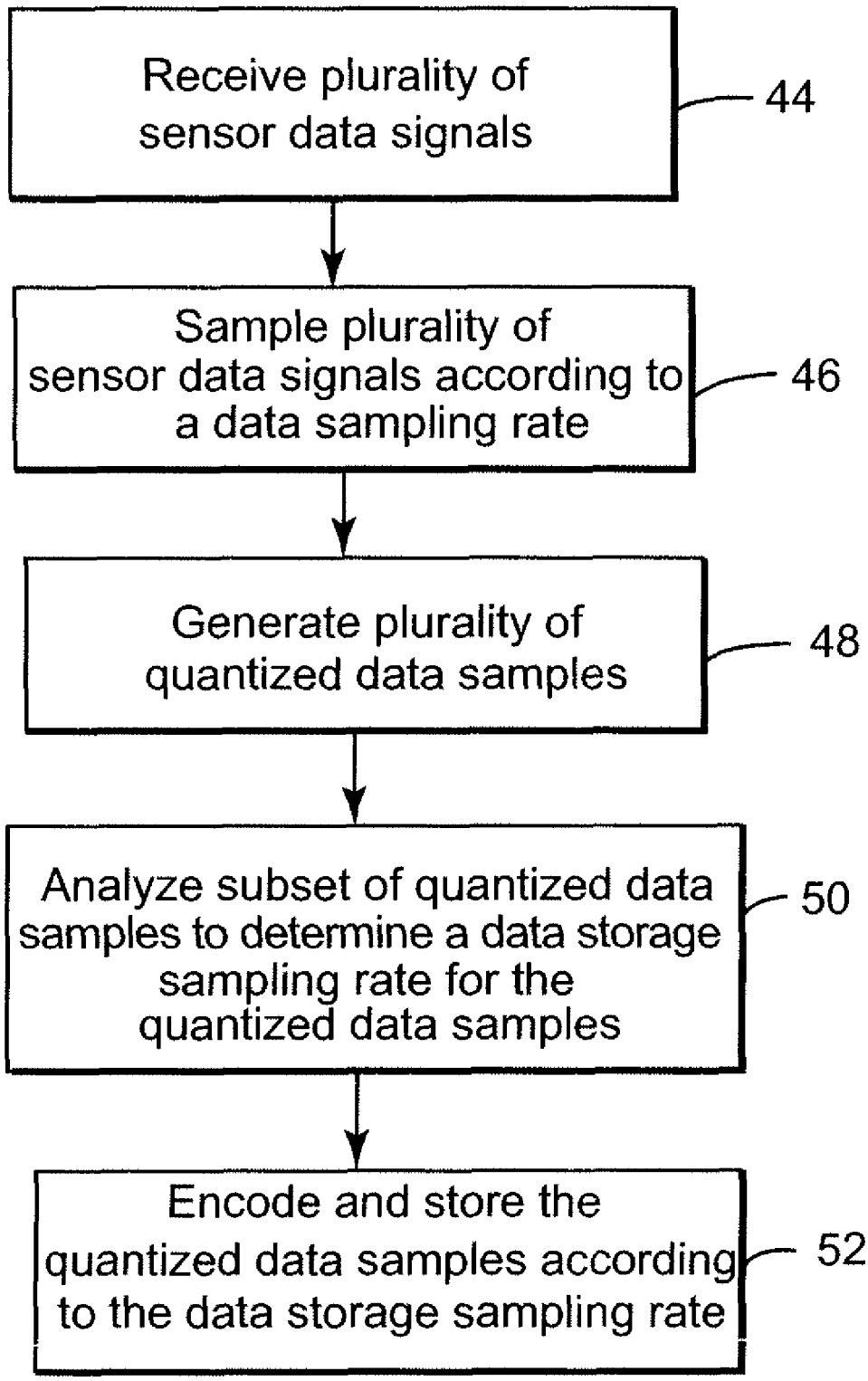
FIG. 7 is a flowchart illustrating exemplary process steps for collecting and storing performance data for an engine, in accordance with one embodiment of the present invention.

FIG. 7 is a flowchart illustrating exemplary process steps for collecting and storing performance data for an engine, in accordance with a method embodiment of the present invention. In step 44, one or more sensor signals representative of one or more engine data performance parameters are received. The engine parameters may include, but are not limited to, exhaust gas temperature, engine fuel flow, core speed, compressor discharge pressure, turbine exhaust pressure and fan speed. In step 46, the sensor data signals are sampled at a data sampling rate. In one embodiment, and as mentioned above, the sensor data signals are sampled at a rate sufficient to sample the sensor data signals for accurate reconstruction, for example, at the Nyquist rate for those periods of time when a sensor data signal exhibits its highest significant frequencies. In step 48, a plurality of quantized data samples corresponding to the sampled sensor data signals are generated. In step 50, a subset of the quantized data samples are analyzed to determine a data storage sampling rate for the quantized data samples. As mentioned above, the analysis comprises determining the down select rate at which the sampled sensor data signals need to be stored, in order to be able to reproduce the quantized data samples with sufficient accuracy, within a pre-defined number of time units. In one embodiment, one or more transient data segments indicative of an operational condition in the engine may further be stored, and an anomalous event may be detected based upon the transient data segments. Further, the data storage sampling rate may be modified based upon the stored transient segments. In step 52, the quantized data samples are encoded and stored according to the data storage sampling rate. In one embodiment, and as mentioned above, the quantized data samples corresponding to the sampled sensor data signals may further be compressed based on one or more correlation measures identified between the engine data performance parameters. An anomalous event may further be detected and the data storage sampling rate modified based on the identified correlation measures. Further, and in one embodiment, the sensors may be monitored based upon the identified correlation measures. The encoded quantized data samples may then be stored or transmitted to a platform other than the host aircraft, such as another aircraft or a ground site.

The disclosed embodiments have several advantages including the ability to collect and store engine data at appropriate sampling rates, while efficiently consuming the available storage capacity before the flight ends. In addition, the disclosed embodiments provide a technique for detecting the occurrence of one or more anomalous events, by identifying and capturing sampled sensor data signals that precede the onset of a fault, based on an analysis of one or more transient data segments comprising the sampled sensor data signals and/or based on the identification of one or more correlation measures between the engine data parameters. Further, embodiments of the present invention disclose a technique for performing the efficient collection and storage of the sampled sensor data, based on the detected anomalous events.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for collecting and storing performance data for an engine, the system comprising:

at least one sensor configured to generate one or more sensor data signals representative of one or more engine data performance parameters;

a data sampling component configured to sample the sensor data signals at a data sampling rate;

a data quantizing component configured to generate a plurality of quantized data samples corresponding to the sampled sensor data signals;

a data storage sampling rate component configured to determine a data storage sampling rate for the quantized data samples, based on an analysis of at least a subset of the quantized data samples;

a data encoding component configured to encode the quantized data samples according to the data storage sampling rate;

a data storage component configured to store the encoded data samples from the data encoding component; and a data buffer component configured to store the quantized data samples at the data sampling rate and to capture and store one or more transient data segments comprising the quantized data samples, wherein the transient data segments are indicative of an operational condition in the engine, wherein the data storage sampling rate component is configured to detect an anomalous event based on the one or more transient data segments and to modify the data storage sampling rate in response to the detection of the anomalous event.

2. The system of claim 1, wherein the analysis comprises identifying at least one frequency component from the sensor data signals.

3. The system of claim 1, wherein the engine data performance parameters comprise at least one of exhaust gas temperature, engine fuel flow, core speed, compressor discharge pressure, turbine exhaust pressure and fan speed.

4. A system for collecting and storing performance data for an engine, the system comprising:

at least one sensor configured to generate one or more sensor data signals representative of one or more engine data performance parameters;

a data sampling component configured to sample the sensor data signals at a data sampling rate;

a data quantizing component configured to generate a plurality of quantized data samples corresponding to the sampled sensor data signals;

a data storage sampling rate component configured to determine a data storage sampling rate for the quantized data samples, based on an analysis of at least a subset of the quantized data samples;

a data encoding component configured to encode the quantized data samples according to the data storage sampling rate;

a data storage component configured to store the encoded data samples from the data encoding component; and a correlation module configured to identify one or more correlation measures between the one or more of engine data performance parameters, wherein the data encoding component is further configured to compress the quantized data samples corresponding to the sampled sensor data signals, based on the one or more identified correlation measures.

5. The system of claim 4, wherein the data encoding component is configured to communicate the one or more identified correlation measures to the data storage sampling rate component and detect an anomalous event based on the one or more correlation measures communicated by the data encoding component.

6. The system of claim 5, wherein the data storage sampling rate component is further configured to modify the data storage sampling rate based on the one or more identified correlation measures.

7. The system of claim 6, wherein the data encoding component is configured to monitor the plurality of sensors, based on the one or more identified correlation measures.

8. A method for collecting and storing performance data for an engine, the method comprising:

receiving one or more sensor data signals, representative of one or more engine data performance parameters;

sampling the sensor data signals at a data sampling rate;

generating a plurality of quantized data samples corresponding to the sampled sensor data signals;

analyzing at least a subset of the quantized data samples to determine a data storage sampling rate for the quantized data samples, wherein the analyzing comprises identifying at least one frequency component from the sensor data signals; and encoding and storing the quantized data samples according to the data storage sampling rate.

9. The method of claim 8, further comprising storing the quantized data samples at the data sampling rate.

10. The method of claim 9, further comprising capturing and storing one or more transient data segments comprising the quantized data samples, wherein the transient data segments are indicative of an operational condition in the engine.

11. The method of claim 10, further comprising detecting an anomalous event based on the one or more transient data segments.

12. A method for collecting and storing performance data for an engine, the method comprising:

receiving one or more sensor data signals, representative of one or more engine data performance parameters;

sampling the sensor data signals at a data sampling rate;

generating a plurality of quantized data samples corresponding to the sampled sensor data signals;

analyzing at least a subset of the quantized data samples to determine a data storage sampling rate for the quantized data samples;

encoding and storing the quantized data samples according to the data storage sampling rate;

storing the quantized data samples at the data sampling rate;

capturing and storing one or more transient data segments comprising the quantized data samples, wherein the transient data segments are indicative of an operational condition in the engine;

detecting an anomalous event based on the one or more transient data segments; and modifying the data storage sampling rate based on the one or more stored transient data segments.

13. A method for collecting and storing performance data for an engine, the method comprising:

receiving one or more sensor data signals, representative of one or more engine data performance parameters;

sampling the sensor data signals at a data sampling rate;

generating a plurality of quantized data samples corresponding to the sampled sensor data signals;

analyzing at least a subset of the quantized data samples to determine a data storage sampling rate for the quantized data samples;

encoding and storing the quantized data samples according to the data storage sampling rate; and identifying one or more correlation measures between the one or more engine data performance parameters and compressing the quantized data samples, based on the one or more identified correlation measures.

14. The method of claim 13, further comprising detecting an anomalous event based on the one or more identified correlation measures.

15. The method of claim 14, further comprising modifying the data storage sampling rate, based on the one or more identified correlation measures.

16. The method of claim 15, further comprising monitoring at least one sensor configured to supply the sensor data signals, wherein the monitoring is based on the one or more identified correlation measures.

* * * * *